United States Patent [19]

Wolfberg

[11] 4,344,555

[45] Aug. 17, 1982

[54] SELF-CYCLING PNEUMATIC FASTENER APPLYING TOOL

[75] Inventor: Robert Wolfberg, Skokie, Ill.

[73] Assignee: Signode Corporation, Glenview, Ill.

[21] Appl. No.: 122,526

[22] Filed: Feb. 19, 1980

[51] Int. Cl.[3] ..... B25C 5/13

[52] U.S. Cl. ..... 227/130; 91/309; 91/318; 91/417 A

[58] Field of Search ..... 91/304, 309, 318, 417 A, 91/300, 461; 227/130

[56] References Cited

U.S. PATENT DOCUMENTS

| | | | |
|---|---|---|---|
| 3,106,136 | 10/1963 | Langas et al. | 91/417 A |
| 3,278,102 | 10/1966 | Siegmann | 227/130 |
| 3,278,103 | 10/1966 | Juilfs et al. | 227/130 |
| 3,278,105 | 10/1966 | Juilfs et al. | 227/130 |
| 3,427,928 | 2/1969 | Bade | 91/309 X |
| 3,477,629 | 11/1969 | Becht | 227/130 |
| 3,496,835 | 2/1970 | Siegmann | 91/461 X |
| 3,547,003 | 12/1970 | Ramspeck | 91/309 X |
| 3,561,324 | 2/1971 | Obergfell | 91/318 X |
| 3,673,923 | 7/1972 | Volkmann et al. | 91/309 |
| 3,683,746 | 8/1972 | Ramspeck | 91/309 X |
| 3,895,562 | 7/1975 | El Guindy | 91/309 X |
| 3,906,835 | 9/1975 | Donnen et al. | 91/318 X |

*Primary Examiner*—Paul A. Bell

*Attorney, Agent, or Firm*—Dressler, Goldsmith, Shore, Sutker & Milnamow, Ltd.

[57] ABSTRACT

A pneumatic fastener applying tool featuring a self-cycling control valve with one moving port. A trigger actuated valve sets the cycling valve in motion. The cycling valve alternatively pressurizes and vents the working piston of the fastener tool. A valve stem is positioned by an integral reciprocating piston. The position of the reciprocating piston is determined by the balance of forces between a biasing spring tending to vent the working piston and a pressure-force tending to pressurize the working piston. Two flow paths, internal to the valve stem, determine the pressure applied to the reciprocating piston. One path pressurizes the reciprocating piston. Another path vents the reciprocating piston. Positive feedback of air pressure from the working cylinder positions the reciprocating piston and valve stem so as to vent the reciprocating piston when the working piston is vented and to pressurize the reciprocating piston when the working piston is pressurized. Releasing the trigger actuated valve holds the cycling valve in place and prevents further operation of the fastener tool.

7 Claims, 3 Drawing Figures

SELF-CYCLING PNEUMATIC FASTENER APPLYING TOOL

DESCRIPTION

1. Technical Field

A pneumatic fastener applying tool for the application of staples, nails and the like. An independent, self-cycling control valve provides automatic repetitive actuation of the fastener applying tool.

2. Background Art

With the increasing demand for higher productivity to offset increasing labor and material costs, pneumatic fastener applying tools have found widespread acceptance in the construction and manufacturing industries. Fastener driving tools using air pressure are favored because of their rugged construction and safety. They are being used to apply nails, staples, and other serially fed fasteners. Because more often than not it is necessary to apply more than one nail or staple to the workpiece, an automatic or self-cycling fastener applying tool is preferred over a single acting or manually actuated single stroke device.

The fastener driving tool illustrated in U.S. Pat. No. 3,106,136 by Langas and assigned to the assignee of the present invention describes a single acting device. Attempts to convert such tools to automatic operation have met some degree of success.

Siegmann (U.S. Pat. No. 3,278,102 and 3,496,835) employs auxiliary pistons actuated by that portion of the compressed air actuating the working piston which is "bypassed" around the working piston at the end of the driving stroke of the working piston. As such, automatic recycling depended upon the movement of the working piston. Becht (U.S. Pat. No. 3,477,629) although not using air bypassed around the working piston, nevertheless uses an auxiliary pistons (i.e., one not joined to the firing valve) to actuate a piston which in turn operates the firing valve. Thus, cycling of the firing valve was dependent upon the cycling of a separate or second piston.

DISCLOSURE OF THE INVENTION

As with any tool, ease of operation and cost of manufacture is generally determined by the number of parts or components used. In other words, the greater the number of cooperating components, the higher the likelihood of failure of the completed mechanism due to a malfunction of any one individual component. Similarly, reducing the number of components alone will not improve reliability and manufacturing costs if the remaining components must be subject to precision machining. Precision devices are more likely to come out of adjustment and more likely to require custom fitted or matched repair parts.

The novel cycling valve herein described below features essentially one moving part and other components not requiring specialized or precision machining. This is expected to reduce the sliding, sticking, and wearing problems often experienced when using small precision pneumatic control assemblies. Furthermore, the cycling valve uses positive feedback to control its operation. Thus, it is self synchronizing and independent of the operation of other components.

Consequently, the tool is expected not only to be reliable but to perform uniformly and smoothly. This combination of reliability, ruggedness, cost effectiveness, and dependability is expected to be unmatched by what has been heretofore offered in the marketplace.

The tool includes a main housing that provides support for the main elements and principal components of the self cycling fastener applying device. These elements include: a magazine of fasteners, such as staples or nails; an air reservoir joined to a source of pressurized air; a working cylinder; and a working piston having a fastener driving device at one end with the opposite end opened to a controlled supply of compressed air.

A cycling valve assembly controls the pressurizing and venting of the cylinder cavity and hence the operation of the working piston. Pressurizing the working piston drives the fastener into the workpiece. Venting the working piston allows the working piston to be returned to its original position. The cycling valve in turn is initially retained in the closed position by a second piston and cylinder assembly. Actuation of a trigger-actuated valve permits the second piston to move out of its initial position to allow the cycling valve to regulate the flow of air between the air reservoir and the driving surface of the working piston. The cycling valve is normally biased by a spring to a position where the chamber above the working piston is vented to atmosphere and the flow between the air reservoir and working piston is cut off.

A piston and cylinder operator is attached to and forms an integral part of the cycling valve assembly. This piston operator includes a peripheral end portion that is continuously exposed to the pressurized air in the air reservoir which acts against the force of the biasing spring. Hence, upon actuation of the trigger valve high pressure air, acting on the peripheral end portion, opens the cycling valve which introduces high pressure air to pressurize the working cylinder above the driving piston and shuts off the vent to atmosphere. The pressurization of the working cylinder also opens a path pressurizing the integral piston operator portion of the cycling valve. The pressure-force applied to the piston operator and the biasing force combine to shut off the supply of air to the working piston and vent the working piston to atmosphere. The pressure in the piston operator is reduced to atmospheric pressure by an internal flow path containing an orifice. This flow path communicates the working piston with the piston operator portion of the cycling valve. Hence, upon venting of the piston operator to atmospheric pressure, the peripheral end portion of the piston operator again overcomes the biasing spring to open the source of pressurized air to the working piston and shut off the vent to the atmosphere. This, in turn, repeats the cycle.

So long as the trigger-actuated valve is held, the cycling valve will control the sequential cycling of the working piston and the sequential ejection of fasteners or staples. Once the trigger is released, the cycling valve is locked in position and the stapling tool is shut off.

BEST MODE FOR CARRYING OUT THE INVENTION

Figure 1:
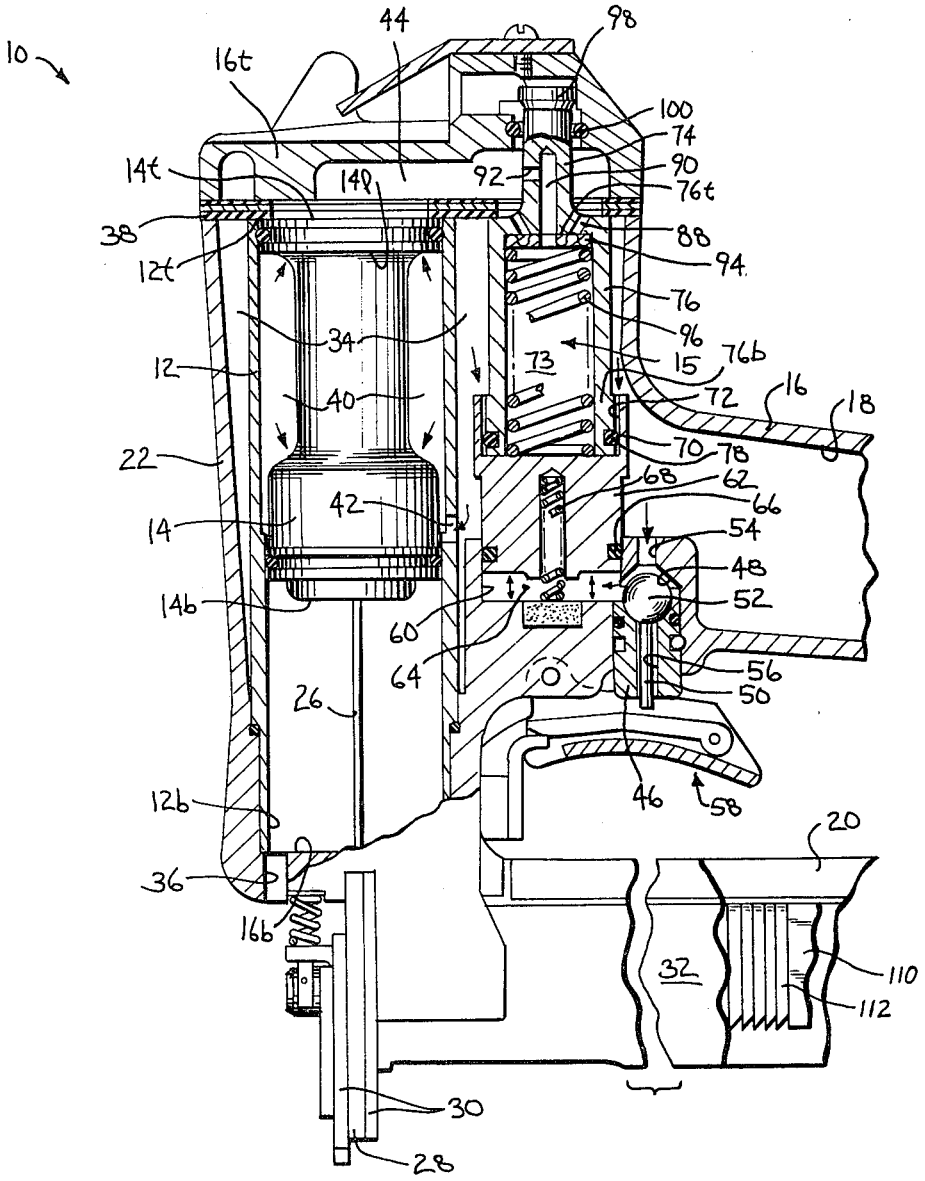
FIG. 1 is a partial side elevational view of a fastener driving tool illustrating the relative position of these components with air applied to the tool before being triggered into operation.

While this invention is susceptible of embodiment in many different forms, there is shown in the drawing and will herein be described in detail a preferred embodiment of the invention with the understanding that the present disclosure is to be considered as an exemplification of the principles of the invention and is not intended to limit the invention to the embodiment illustrated. The scope of the invention will be pointed out in the appended claims.

FIG. 1 illustrates a fastener driving tool 10 having a pneumatic motor assembly which includes a cylinder 12 and a working piston 14 slidably mounted within the cylinder. A novel, integral, cycling valve assembly 15, as described herein, is used to sequentially and repetitively control the reciprocating cycle of the working piston. Although the invention is described as embodied in a fastener driving tool, it is to be understood that the cycling valve and pneumatic motor assembly are equally adaptable to many other applications; also, the described fastener tool is exemplary of other tools with which the present invention can be used.

The common point of attachment for the various components of the fastener drive tool 10 is the housing 16. The housing 16 is hollow and includes a graspable elongated storage chamber portion 18. The housing 16 also includes a generally upright cylinder portion 22. The storage chamber 18 is adaptable to contain pressurized air and is coupled to a suitable source of air at one end (not shown) of the chamber through a hose and suitable coupling means.

Carried at the lower end **14*b* of the piston is an elongated fastener driver means 26 that extends vertically through a central slot 28 between two guides 30 that are part of the lower end of housing 16. These guides 30 are secured to the lower end of the housing 16. The magazine assembly 32 holds staples in a row extending transversely to the path of the driver means 26 and supplies staples 112 by the action of pusher 110 serially under the driver to be driven when the working piston 14 with attached driver means 26 descends towards the lower edge of the cylinder 12*b***. This is one conventional way that is described in detail in aforementioned Langas et al. *U.S. Pat. No.* 3,106,136.

The cylinder 12 forms the stationary portion of the pneumatic motor assembly. The cylin- der 12 is of a smaller diameter and length than the associated housing portion 22 and is centrally disposed therein so that an annular chamber 34 is defined between the outer wall of the cylinder 12 and the inner wall of the housing portion 22 of the housing 16. The lower end of the cylinder **12*b* is closed by the housing 16*b* with the exception of an equalization port 36. The annular chamber 34 is filled with pressurized air by being in direct communication with the storage chamber 18**.

The housing 16 also contains a valve cover portion **16*t*. The valve cover closes the upper end of the cylinder 12 and provides a chamber 44 that defines a path for pressurized air to enter and leave the area adjacent the upper end 14*t* of the working piston. A gasket 38 provides a seal between the valve cover portion 16*t* of the housing and the cylinder portion 22** of the housing.

The second principal part of the pneumatic motor assembly is the working piston 14, that is slidably mounted within the cylinder 12. The working piston 14 has upper and lower ends **14*t*, 14*b* respectively and is movable between the cylinder ends 12*t* and 12*b* from the driving position to the driven position respectively. The working piston may be normally biased to its upper end 12*t* of the cylinder by any suitable means such as a spring or magnet. Preferably, however, the working piston 14 and cylinder 12 are constructed so as to define an annular chamber 40 between the upper end 14*t* and the lower end 14*b* of the working piston. This annular volume is continuously supplied with pressurized air from the storage chamber 18 via ports 42 in the cylinder walls. The exposed area of the bottom surface 141 of the upper end 14*t* of the working piston is greater than the area of the lower end 14*b* of the working piston in chamber 40** resulting in a net unbalanced upward force thereon when both areas are exposed to air of the same pressure. For more particular details of such a "piston bias means," reference should be made to the Langas patent previously referenced.

During the fastener driving operation the working piston 14 is moved downwardly into cylinder 12 in opposition to the biasing force provided by pressurized air in chamber 40. The upper end of the valve cover **16*t* defines a cylinder chamber 44 ducting compressed air to and from the upper end 14*t* of the working piston. After completion of the downward or working stroke, the chamber 44 is exhausted which allows the air pressure in chamber 40 to return the piston to the upper end 12*t*** of the cylinder. This is referred to as the return stroke of the working piston.

In order to periodically admit pressurized air to drive the working piston 14 downwardly, a novel self-cycling valve assembly 15 is provided. Unlike prior valve expedients this valve assembly is characterized by the use of relatively large, easily machinable components not requiring close tolerance control for fit-up or components susceptible to coming out of adjustment due to fatigue resulting from continual recycling. Especially unique is the utilization of an independent one-piece member to serve as the main portion of the valve and the valve operator. As such, the device is expected to give long term trouble-free operation. The cycling valve assembly is located within the housing 16 in the immediate vicinity of the upper end **12*t*** of the working piston cylinder.

The cycling valve assembly is placed in operation by means of a trigger-actuated control valve 46. The control valve is mounted within the housing 16 adjacent the lower end of the cylinder portion 22 and between the air storage chamber 18 and the cycling valve assembly 15. The control valve includes a central flow chamber 48 into which a shaft valve element 50 is inserted. The central flow chamber 48 houses a ball valve element 52. Meeting at the central flow chamber is an inlet port 54 and an exhaust port 56 extending generally vertically and respectively above and below the flow chamber. Inlet port 54 communicates with the storage chamber 18 and exhaust port 56 communicates with the outside atmosphere. A finger actuated trigger asssembly 58 operates the valve plunger or shaft 50 which moves the ball 52 vertically from a first position (where the ball seals the exhaust port 56 and opens the inlet port 54) to a second position (where the ball seals the inlet port 54 and opens the exhaust port 56—see FIG. 2).

Normally, (see FIG. 1) the ball 52 is at rest in the lower part of the flow chamber 48 in its first position. Pressure supplied from the air storage chamber 18 forces the ball against the lower seat of the flow chamber 48 thereby sealing the exhaust port 56. In this sense the upper portion of the ball acts as a pressurized surface forcing the lower portion of the ball in contact with the exhaust port 56 valve seat. Thus, the valve may be classified as a two position, three way valve that is piloted towards the first position and manually actuated to the second position. It functions as a pressurizing and venting valve means.

Immediately adjacent to the control valve 46 is a cylindrical cavity 60 into which a piston means 62 is fitted. The chamber 64, defined by the lower end of the piston 62 and the cylinder 60, is in flow communication with air storage chamber 18 via inlet port 54, thus providing the chamber 64 with a source of pressurized air. The pressurization of the chamber 64 forces the piston 62 upwardly. For convenience, and for reasons that will become apparent shortly, piston 62 will be referred to as the "lower piston" and chamber 64 will be referred to as the "lower chamber". The lower chamber is shown sealed by O-ring 66. The lower piston is biased to an upward position by a biasing means 68, such as a coil spring, keeping the lower piston separated from the bottom of the cylinder 60. The upper portion of the lower piston features a skirt portion 70 defining an open ended cylinder 72—hereafter referred to as the "upper cylinder" (see FIG. 3).

Cooperating with the upper cylinder 72 is the cycling valve assembly 15. The cycling valve assembly includes two principal functional elements: a control valve stem 74 and a upper piston 76. The lower portion 76*b* of the upper piston 76 (see FIG. 3) cooperates with, and is slidably disposed within the skirt 70 of upper portion of the lower piston 62. The lower portion 76*b* of the upper piston 76 features a wider diameter than the main body of the upper piston. A gasket means 78 seals the space between the outer portion of the upper piston and the inner portion of the upper cylinder. The upper piston cooperating with the upper cylinder defines the upper chamber 73. The upper portion of the upper piston 76*t* cooperates with the gasket 38 sealing the cylinder chamber 44 from the air storage chamber 18. The upper portion of the upper piston 76*t* together with the gasket form a valve plug and seat to control the admission of pressurized air into the cylinder chamber 44. Thus, the pressurization of the lower chamber 64 forces the upper portion 76*t* of the upper piston 76 into contact withthe sealing surfaces of the gasket 38. This seals the air storage chamber 18 from the working piston 14 as a source of pressurized air. Effectively, the lower piston 62 acts as a means to hold the cycling valve assembly 15 in sealing position against gasket 38 thereby preventing its recycling function by reciprocal movement thereof. The control valve 46 activates or "starts" the cycling valve assembly when the trigger 58 is depressed, and "shuts-off" the cycling function when the trigger is released.

Figure 2:
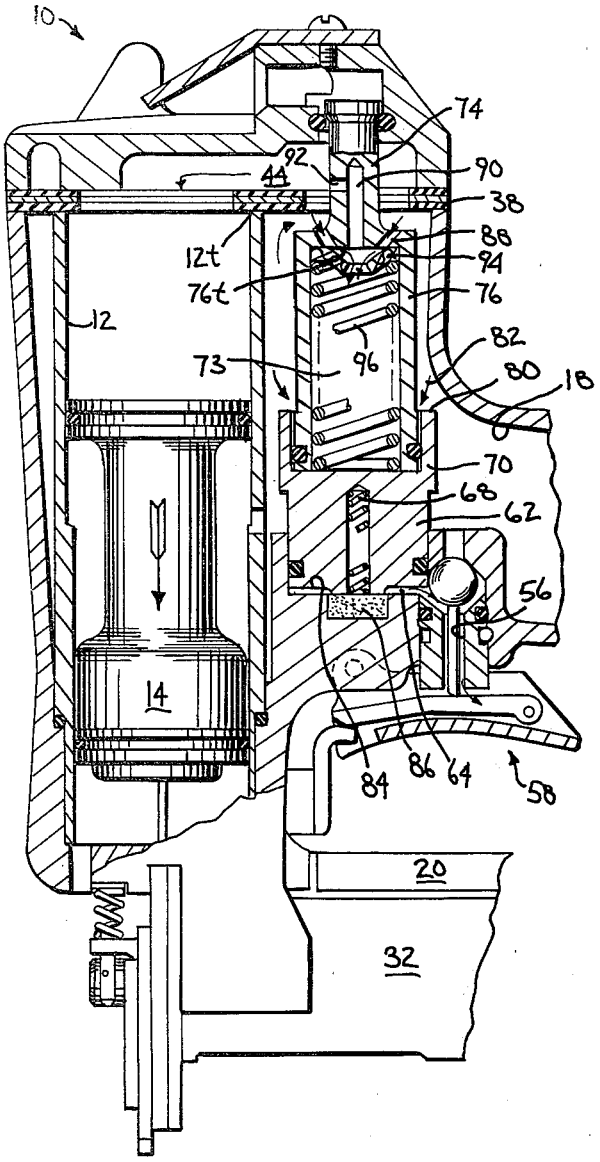
FIG. 2 is a partial side elevational view of the fastener driving tool of FIG. 1 illustrating the position of the principal components during the driving stroke.

Referring to FIG. 2, the surface area 82 of the annular lower portion 76*b* of the upper piston 76 is less than the surface area 84 of the lower portion of the lower piston 62. This unbalanced surface area 82 results in a net downward force contribution from the pressure-force on this area. This downward force will be exceeded by an upward force created by pressurization of the lower chamber 64. Thus, when the trigger assembly 58 is raised to move the shaft 50 to push the ball 52 upwardly, the inlet port 54 is shut off and the exhaust port 56 is opened to vent the lower chamber 64 to atmosphere. As the pressure in the lower chamber decreases, the resulting downward force, provided by the pressure exerted on the surface 82 of the lower portion of the upper piston 76, overcomes the force provided by the biasing means 68 resulting in the lower piston 62 assuming the position shown in FIG. 2. Simultaneously, upper piston 76 withdraws from the gasket 38 thereby exposing the cylinder chamber 44 to the air in the storage chamber 18.

Since the depressurization of the lower chamber 64 is preferably accomplished in rapid fashion, a bumper means 86 is provided to soften the impact of the lower piston comming into contact with the lower face of the lower cylinder 60. This bumper also decreases the noise level of the device when it is in operation.

Referring to FIG. 2, the upper portion of the upper piston 76 includes several elements that provide the cycling valve with its unique self cycling capability. A series of annularly spaced passageways 88 in the upper portion 76*t* provide a first flow path means which interconnects the upper chamber 73 and the cylinder chamber 44. A second flow path means or passageway 90 is provided at the center of the upper end of the upper piston in the stem portion 74. The central passageway 90 is joined by an opening 92 in the stem which establishes flow communication with the cylinder chamber 44.

The stem portion 74 is an integral part of the cycling valve means 15. This stem portion contains a valve plug means 98. This valve plug means 98 seats against a seating surface 100 in the valve cover 16*t*. As illustrated, an O-ring is used for a replaceable valve seat 100. Thus, plug means 98 affects flow communication between the working piston 14 and the atmosphere via the cylinder chamber 44. It also functions as a valve means in directing and controlling the flow of exhaust air from the cylinder chamber 44 to the atmosphere. It thus "vents" the cylinder chamber 44 to the atmosphere. When the upper piston 76 is driven upwardly, the valve stem 74 opens a path between the seating surface 100 and the plug 98. This results in the discharge of compressed air contained in the cylinder chamber 44 and the upper portion 12*t* of the working cylinder. To protect workers from the force of a pulse of exhausting air, a baffle plate 102 is included. To protect baffle plate from mechanical damage and to otherwise deflect the jet of exhaust gasses, a deflector 104 is provided as an integral portion of the valve cover 16*t*.

Referring to FIG. 1, located at the upper portion 76*t* of the upper chamber 73 is a flexible annular gasket means 94. This gasket is positioned against the upper portion 76*t* of the upper chamber by a biasing means 96 such as a coiled spring. This bias spring 96 also functions to keep the upper piston 76 normally seated against the sealing gasket 38 to cut off the flow of high pressure air to the driving piston. The spring 96 applies a contact force generally along the outer perimeter of gasket 94. The passageways 88 joining the upper chamber 73 with the cylinder chamber 44 intersect the gasket 94 inside of the coils of the biasing spring 96. These flow paths 88 are directed such that the gasket means 94 is free to flex downwardly upon the application of a net pressure-force directed from the cylinder chamber 44 towards the upper chamber 73. The gasket means 94 is free to flex in a generally downward direction. Thus, if a pressure difference appears across the gasket means 94 such that there is greater pressure in the cylinder chamber 44 than in the upper chamber 73, the gasket means will be flexed to open the flow passageways 88. Similarly, when the differential pressure between the upper chamber 73 and cylinder chamber is equalized, the gasket 94 is free to return to the unflexed condition. When it draws toward the upper end *76t* of the upper chamber, the upper chamber 73 is sealed from the cylinder chamber 44 via flow passageways 88. In this sense it provides a one directional flow control means. In effect, it performs as a check valve or non-return valve means.

Since the gasket means 94 is washer-like in shape, it does not interact with the central flow passageway 90 and orifice 92. Thus, the upper chamber 73 is in constant communication with the cylinder chamber 44. Passageway 92 is sized in such a manner that the volume rate of flow passing through the central stem passageway 90 is much less than the volume rate of flow passing through passageway 88. Thus, passageway 90 and orifice 92 function restricts the flow passing through the hollow stem 74. This volume rate of flow difference effectively "times" and controls the cycling of the recycling valve assembly 15. It insures that the working piston 14 completes its power or downward stroke and returns to the starting position before pressurized air is readmitted to the working cylinder 12. Significantly, the stroking of the working piston 14 or an auxiliary piston is not needed for recycling to occur.

The integrated and coordinated operation of the various components will now be described. Pressing the trigger 58 sets the stapler in operation. Air is cut off from the lower chamber 64, and the lower piston 62 moves down into the position shown in FIG. 2. Since the upper chamber 73 was vented to atmosphere, the upper piston 76 likewise moves downwardly. Air from the storage chamber 18 is then free to flow into chamber 44. This activates the working piston 14 and drives a staple from the magazine 32. At the same time, pressurized air also enters the two stem located passageways 88 and 90 joining the upper piston 76. Because the upper chamber 73 was initially at atmospheric pressure, the gasket means 94 flexes downwardly. This rapidly pressurizes the upper chamber 73. Although air enters the upper chamber 73 through the second passageway 90, the total volume rate of flow entering the upper chamber is essentially due to that of the first passageway 88. The volume of the upper chamber 73 and the rate of pressurization are sized by design to allow the working piston 14 to perform its working stroke before the upper chamber 73 becomes fully pressurized. Thus, operation of the cycling valve is independent of the stroking of the working piston or any auxiliary piston.

Figure 3:
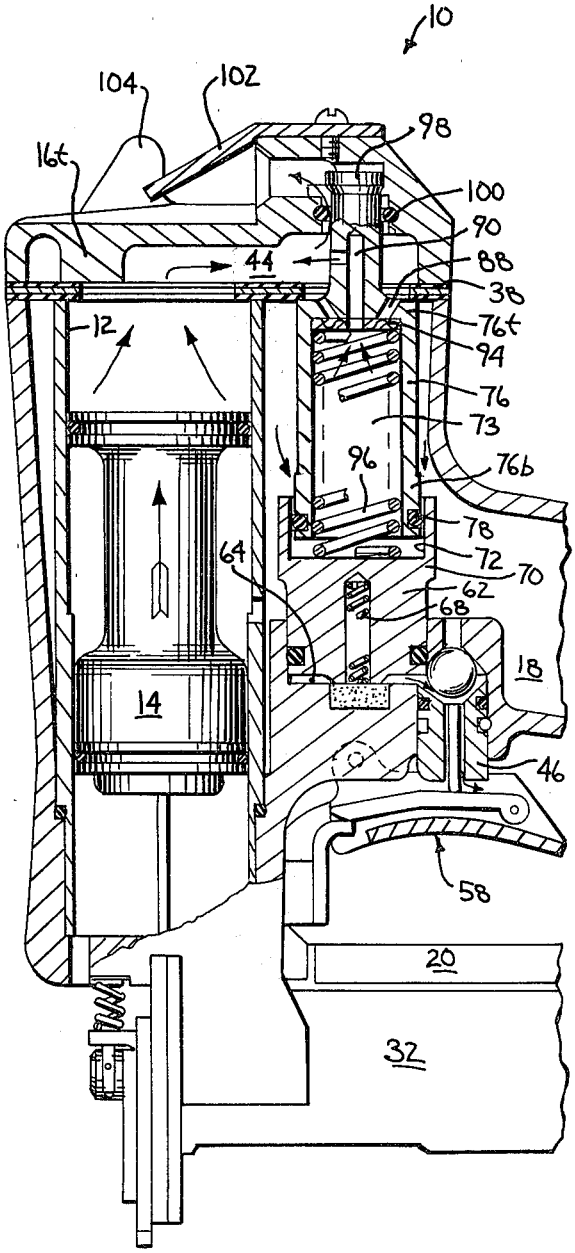
FIG. 3 is a partial side elevational view of the fastener driver tool shown in FIG. 1 illustrating recovery from the driving stroke.

Referring to FIG. 3, once the upper chamber 73 is fully pressurized, the biasing means 96 and the resultant upward force due to the pressurized air exerting an unbalanced upward force on the upper portion of chamber 73 results in the upper piston 76 being forced upwardly and away from the lower piston 62. This causes the upper portion *76t* of the upper piston 76 to come in contact with the valve gasket 38. This cuts off the source of pressurized air to the working piston 14 and at the same time repositions the hollow stem portion 74 and its integrally connected valve plug means 98.

Once the valve plug 98 opens, exhaust gasses from the upper end of the working piston cylinder 14 are discharged to the atmosphere. In addition, the pressurized air stored in the upper chamber 73 vents, via the second flow path 90 and orifice 92, to the atmosphere. Recalling that the second passageway is smaller and carries a much lower volume rate of flow than the first flow passageway 88, the time needed to vent the upper chamber 73 is longer than the time needed to pressurize the upper chamber. This "venting time" is set by design to be of sufficient duration that the working piston 14 returns to the upper end *12t* of its stroke before the upper piston 76 repositions.

It should be noted that the upper piston moves upwardly by a combination of the decreased pressure-force of the air in the upper chamber 73 (since it is venting to atmosphere) and the force of the biasing spring 96. Once the pressure in the upper chamber 73 is reduced to atmospheric pressure, the upper piston 76 is forced in the downward direction (See FIG. 2) by virtue of the pressure-force acting upon the peripheral or annular surface area 82 (i.e., those surfaces continuously exposed to air pressure in the air storage chamber 18) of the upper piston 76. The upper piston 76 repositions relative to the upper cylinder 72 such that the cycling valve assembly reassumes the configuration shown in FIG. 2. This cycling action will be repeated as long as the lower piston is in its downward position (i.e. the trigger 58 is held) and as long as air is supplied to the air storage chamber 18.

Upon releasing of the trigger 58, the ball 52 in the control valve 46 is allowed to assume its first position (FIG. 1). This shuts off the exhaust port 56 to the atmosphere and admits pressurized air from the air storage chamber 18 into the lower chamber 64. Because the lower end 84 of the lower piston 62 has a greater surface area than the skirt portion 82 of the upper piston 76 and because the pressure-force of the lower piston 62 is greater than the force of the biasing means 96 of the recycling valve, the lower piston 62 will be driven upwardly. This drives the upper piston 76 upwardly such that pressurized air is shut off from the working piston 14. The exhaust valve plug 98 is, in turn, unseated from its seat 100. This opens the exhaust flow path from the upper chamber 73 and the cylinder chamber 44 to atmosphere. The stapler is then shut off.

In summary: Once the valve is "triggered" into operation, the pressurization condition of the upper chamber 73 determines the position of the cycling valve 15. The pressurization condition of the cycling valve 15 is effectively determined by the position of valve itself; it operates independently of all other cycling components including the working piston 14.

It will be appreciated that the improved cycling valve assembly 15 provides an increase in efficiency, driving force and speed of operation at any given air pressure in comparison with prior art expedients. This is because the cycling valve is "self controlling". The same pressure that is directed to the working piston 14 is used to control the position of the cycling valve. Furthermore, the recycling valve assembly has essentially only one moving part. This feature increases the reliability of operation.

Of course, as was otherwise stated, the recycling valve assembly may be used in related tool applications or indeed in any application calling for the use of such a cycling pulse of pressurized air. Neither is the invention limited to air powered applications since it is equally applicable to other appropriate fluids.

What is claimed is as follows:

1. In a fastener applying device having a housing joined to a supply of fluid under pressure and including a working cylinder having a fastener driver means reciprocable therein in a cycle including one working and one return stroke, a first means for biasing said fastener driver means to the end of said return stroke, a means for feeding a fastener into position to be driven after each return stroke of said fastener driver means, a main valve means for controlling the flow of said fluid under pressure into said working cylinder above said fastener driver means and, an exhaust valve means for venting to atmosphere that portion of said working cylinder above said fastener driver means, an improved control structure comprising:

(a) a control cylinder having one end closed and one end opened to said supply of fluid pressure in said housing;

(b) a control piston movable within said control cylinder from a first position to a second position effective to open said main valve means and to close said exhaust means, said control piston being integral to said main valve means, said control piston and the closed end of said control cylinder defining a control chamber, the first side of said control piston being defined as that side of said control piston continuously exposed to the air pressure in said housing, said housing pressure thus biasing said control piston to said second position;

(c) a first flow means in said control piston for effecting flow communication between said control chamber and said supply of fluid under pressure;

(d) a second flow means in said control piston for effecting flow communication between said control chamber and the atmosphere;

(e) means responsive to the pressure above said fastener driver means for sequentially closing said second flow means and opening said first flow means, and closing said first flow means and opening said second flow means to the effect that said control piston is cycled between said first and said second positions with said fastener driver means being cycled through said working and return strokes in response thereto.

2. In a fastener applying device as recited in claim 1, wherein said means for sequentially closing said second flow means and opening said first flow means, and closing said first flow means and opening said second flow means comprises: a cycling valve stem operatively joining said control piston with said main valve means, said cycling valve stem being normally disposed by a second biasing means to said first position where said main valve means shuts off flow, said first and said second flow means being integral to said valve stem and joining the working cylinder side of said main valve means to said control chamber, the opening of said main valve means pressurizing said control chamber via said first flow means, said second biasing means overcoming the pressure-force on said first side of said control piston upon the pressurization of said control chamber and positioning said main valve means to said first position where said control chamber is vented to atmosphere via said second flow means, said control piston returning to said second position upon the venting of said control chamber, the pressure-force on the first side of said piston overcoming said second biasing means, thereby repeating the cycle.

3. In a fastener applying device as recited in claim 2, further including a flexible member interposed between said first flow means and said second biasing means, said second biasing means retaining said flexible member against the second side of said control piston and preventing flow from said control chamber by way of said first flow means, said second biasing means being opposed by the difference in pressure between said first side and said second side, said flexible member in response to a higher pressure-force on said first side than the pressure-force on said second side flexing away from said second side and opening said first passageway to the effect that said first flow means passes flow from said working cylinder whenever said working cylinder is pressurized and said control chamber is vented.

4. In a fastener applying device as recited in claim 3, further including a valve stem means joining said cycling valve stem on said main valve means with said exhaust valve means such that said main valve means and said exhaust valve means operate alternatively and in sequence, one being fully open when the other is fully shut.

5. In a fastener applying device for use with a supply of fluid under pressure and including a working cylinder having fastener driver means reciprocable therein in a cycle including one working and one return stroke, a first means for biasing said fastener driver means to the end of said return stroke, means for feeding a fastener into position to be driven after each return stroke of said fastener driver means, a main valve means for controlling the flow of said fluid under pressure into said working cylinder above said fastener driver means, and exhaust means for said working cylinder above said fastener driver means, an improved control structure comprising:

(a) a one piece valve control stem for said main valve means and said exhaust means, said stem movable from a first position to a second position effective to sequentially open said main valve means and to close said exhaust means; and (b) a cycling means, integrally joined to said control stem, for effecting continuous movement of said control stem from said first position to said second position and back to said first position, said cycling means having a first surface continuously exposed to said source of fluid under pressure and a second surface continuously exposed to the pressure on said working cylinder above said fastener driver means, the pressure forces on said first and second surfaces additively combining (1) to force said control stem to one end of its cycle when said working piston is vented, and (2) to force said control stem to the opposite end of its cycle when said working cylinder is pressurized.

6. In a fastener applying device as defined in claim 5, wherein said cycling means comprises:

(a) a piston operator free to reciprocate between two positions, said operator being displaced from a first position to a second position upon being pressurized, said operator returning to said second position upon being vented to atmosphere, said first and second surfaces defining the faces of said piston;

(b) a unidirectional flow control means for pressurizing said piston operator when said operator is vented to atmosphere, said unidirectional means being integral to said control stem;

(c) an orificing means for controlling the venting of pressure from said piston operator, said orificing means passing flow at a lower flow rate than said pressurizing means, said orifacing means being integral to said control stem; and (d) a second biasing means for urging said piston operator towards said second position; the pressure-force in said piston operator additively combining with said second biasing means to oppose said pressure-force on said first surface (1) to force said control stem to one end of its cycle, when said piston operator is vented and (2) to force said piston operator to the opposite end of its cycle, when said piston operator is pressurized.

7. In a fastener applying device as defined in claim 6, further including means for holding in position said piston operator to terminate the movement of said control stem.

* * * * *